US007918338B2

(12) United States Patent
Dweck et al.

(10) Patent No.: US 7,918,338 B2
(45) Date of Patent: Apr. 5, 2011

(54) CONVERTIBLE HANGTAG DISPLAY

(75) Inventors: Bert H. Dweck, Long Branch, NJ (US); Boris J. Duchatellier, Staten Island, NY (US)

(73) Assignee: Berkshire Fashions, Inc., New York, NY (US)

( * ) Notice: Subject to any disclaimer, the term of this patent is extended or adjusted under 35 U.S.C. 154(b) by 121 days.

(21) Appl. No.: 12/388,765

(22) Filed: Feb. 19, 2009

(65) Prior Publication Data

US 2010/0011634 A1 Jan. 21, 2010

(51) Int. Cl.
*B65B 85/00* (2006.01)

(52) U.S. Cl. ..... 206/469; 206/467; 229/117.19

(58) Field of Classification Search ..... 206/461, 206/464, 467, 469, 806, 495, 481; 229/117.12, 229/117.18
See application file for complete search history.

(56) References Cited

U.S. PATENT DOCUMENTS

| | | | | | |
|---|---|---|---|---|---|
| 3,278,015 | A | * | 10/1966 | Bernstein | 206/578 |
| 3,343,743 | A | * | 9/1967 | Hamilton, Jr. et al. | 229/117.24 |
| 3,651,929 | A | | 3/1972 | Stoll | |
| 3,946,936 | A | * | 3/1976 | Brown | 229/117.18 |
| 3,964,606 | A | * | 6/1976 | Hogg et al. | 206/395 |
| 4,344,533 | A | * | 8/1982 | Olsen | 206/459.5 |
| 4,360,106 | A | * | 11/1982 | Irvine et al. | 229/212 |
| 4,413,730 | A | * | 11/1983 | Morse | 206/232 |
| 4,887,709 | A | * | 12/1989 | Shimamine | 206/6.1 |
| 4,917,291 | A | | 4/1990 | Saiki et al. | |
| 4,949,845 | A | * | 8/1990 | Dixon | 229/212 |
| 5,193,676 | A | * | 3/1993 | Gold | 206/296 |
| 5,263,586 | A | * | 11/1993 | Keable | 206/469 |
| 5,292,003 | A | | 3/1994 | Baghdassarian | |
| D386,966 | S | | 12/1997 | Seelig | |
| 5,706,947 | A | | 1/1998 | Hodges | |
| 5,755,327 | A | | 5/1998 | Saltzman et al. | |
| 5,836,508 | A | | 11/1998 | Savage | |
| 6,070,719 | A | | 6/2000 | Pollock | |
| D482,612 | S | | 11/2003 | Hager et al. | |
| 6,659,271 | B2 | | 12/2003 | Parsons | |
| 7,222,446 | B2 | | 5/2007 | Foster | |
| 7,451,909 | B2 | | 11/2008 | Sexton | |

OTHER PUBLICATIONS

Fetpak Inc., Hang Tabs—Slot Hang Tabs, Round Hang Tabs & Hook Hang Tabs, Screenshot of webpage at http://www.fetpak.com/whstore/main.pl/fl?34, viewed on Nov. 19, 2008.

Fetpak Inc., Hang Tabs—Clear, Permanent Adhesive, Screenshot of webpage at http://www.fetpak.com/whstore/main.pl/itl?137, viewed on Nov. 19, 2008.

* cited by examiner

*Primary Examiner* — David T Fidei
(74) *Attorney, Agent, or Firm* — Gordon & Jacobson, PC

(57) ABSTRACT

A convertible hangtag display comprising a unitary piece of material foldable into a hanging portion for hanging and displaying a retail item and a boxing portion for packaging the retail item is provided. The hanging portion is separable from the boxing portion along a perforation. The boxing portion has oppositely facing front and rear sheets connected by a crease and a seam. Upper and lower flaps are provided at opposite ends of each of the sheets. Upper and lower creases corresponding to the upper and lower flaps are provided such that the upper and lower creases are foldable about the corresponding creases. At least one crease is provided to the hanging portion opposite the perforation for bending the hanging portion. The hanging portion defines a slot for guiding a hook or other standard display means from which the unitary piece may be suspended. In a display configuration, the upper and lower flaps extend coplanar with the respective sheets from which they extend. After the item is purchased and the hanging portion is removed from the unitary piece, the boxing portion may be folded into a box configuration for packaging the purchased item.

19 Claims, 6 Drawing Sheets

CONVERTIBLE HANGTAG DISPLAY

BACKGROUND OF THE INVENTION

1. Field of the Invention

This invention relates broadly to hanging displays for retail items. More particularly, this invention relates to a convertible hangtag display which is used to showcase a retail item prior to its purchase and which is convertible into a gift box for storing the item after it is purchased.

2. State of the Art

Retail establishments often display various items by securing the items to cardboard or plastic material and suspending the items from hooks which hook onto the cardboard or plastic material. Customers can then view the items and remove them from the hook for purchasing. Items that are commonly displayed in this manner include apparel and accessories such as ties, socks, gloves, scarves, watches, wrist bands, jewelry, knickknacks, and the like.

SUMMARY OF THE INVENTION

The present invention is directed to a hangtag display which is convertible into a gift box. The hangtag display is formed from a unitary piece of material such as cardboard or plastic, and includes a hanging portion which hangs and displays an item secured to the unitary piece of material for viewing by the purchasing public in retail establishments, and a boxing portion which folds into a box for packaging the item after it has been purchased. The hanging and boxing portions of the unitary piece of material are separable along a perforation.

The boxing portion includes oppositely facing front and rear sections. The front and rear sections are connected at a crease on one side and at a seam on an opposite side. Each of the front and rear sections includes a sheet, as well as upper and lower flaps which bend about respective creases at opposite ends of the sheet. According to one aspect of the illustrated embodiment, the respective creases at opposite ends of the sheet are shaped in a concave arc. According to another aspect of the illustrated embodiment, the upper and lower flaps of the front and rear sections are ellipsoidal in shape, and contain notches for gripping the upper and lower flaps to assist with folding the flaps about their respective creases. According to yet another aspect of the illustrated embodiment, perforation fold runs along the upper flap of the rear section of the boxing portion.

The hanging portion preferably includes a crease for folding the hanging portion into a configuration in which it extends from the rear section of the boxing portion up and over the front section of the boxing portion. The hanging portion also includes at least one hole for receiving a plastic fastener which secures the display item to the hanging portion, and a slot for receiving a hook or other clasp from which the hangtag display and item secured thereto may be suspended. The slot of the hanging portion is preferably located between the perforation and an end section, and is preferably symmetrical about a crease of the hanging portion.

In a display configuration, the upper and lower flaps of the front and rear sections of the boxing portion extend from and coplanar with the respective sheets of the front and rear sections from which they extend. The display item is preferably situated in front of the front section. The end section of the hanging portion is also preferably situated in front of the front section of the boxing portion such that the displayed item is situated or sandwiched and held between the front section of the boxing portion and the end section of the hanging portion whereby the item for sale is visible and at least partially accessible to a customer.

In a box configuration in which the hanging portion and boxing portion have been detached from each other at the perforation, the upper and lower flaps of the respective sheets of the front and rear sections can be folded so as to extend in a transverse direction relative to the respective sheets whereby the sheets and upper and lower flaps form a box for packaging or storing the item. Additionally, in the box configuration, the sheets of the front and rear sections are preferably bowed outward opposite each other, thus providing an aesthetically pleasing shape to the box and an interior portion which accommodates display items of different sizes.

Additional objects and advantages of the invention will become apparent to those skilled in the art upon reference to the detailed description taken in conjunction with the provided figures.

DETAILED DESCRIPTION OF THE PREFERRED EMBODIMENT

Figure 1:
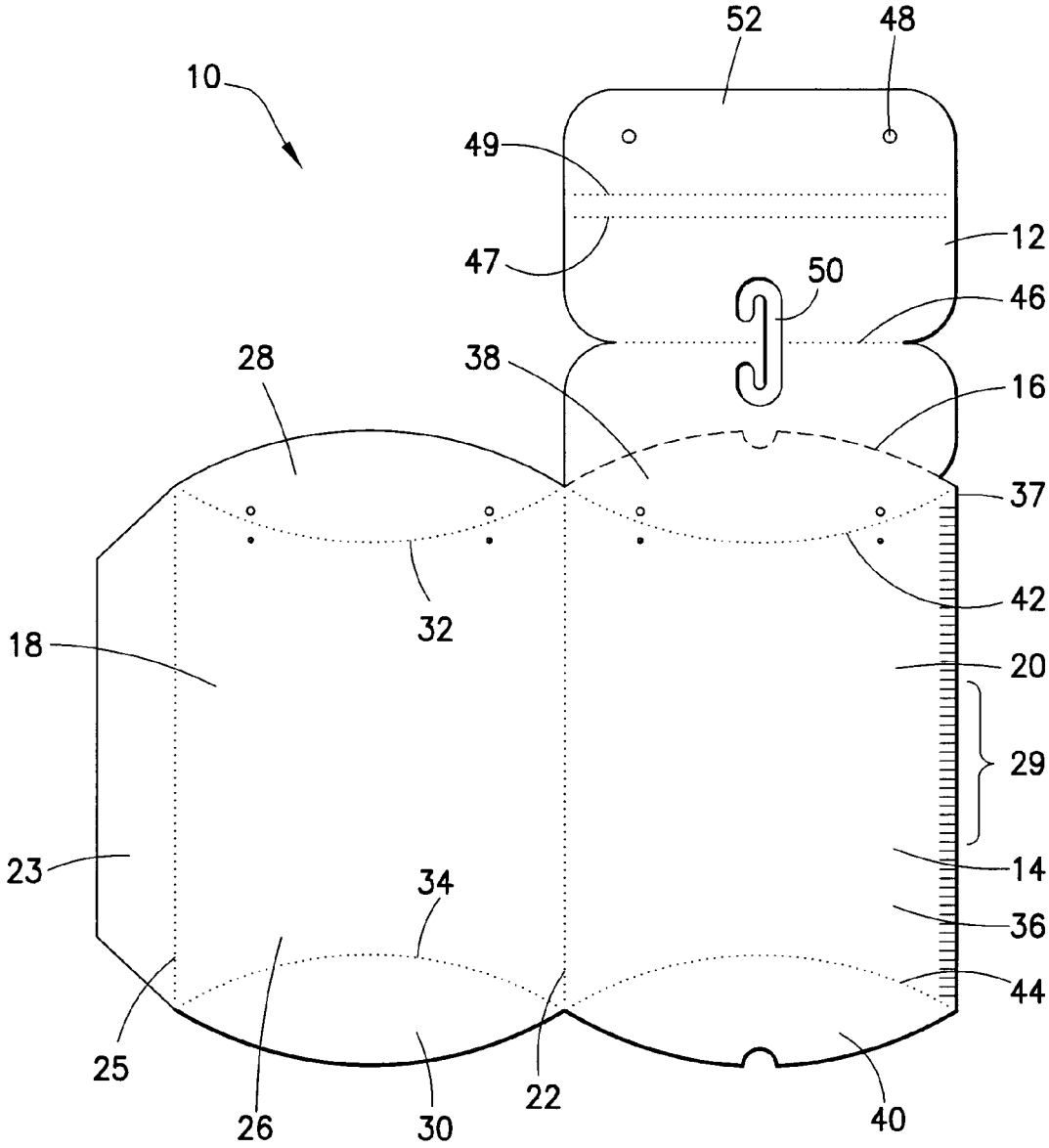
FIG. 1 is an unfolded schematic view of the convertible hangtag of the invention.
Figure 3:
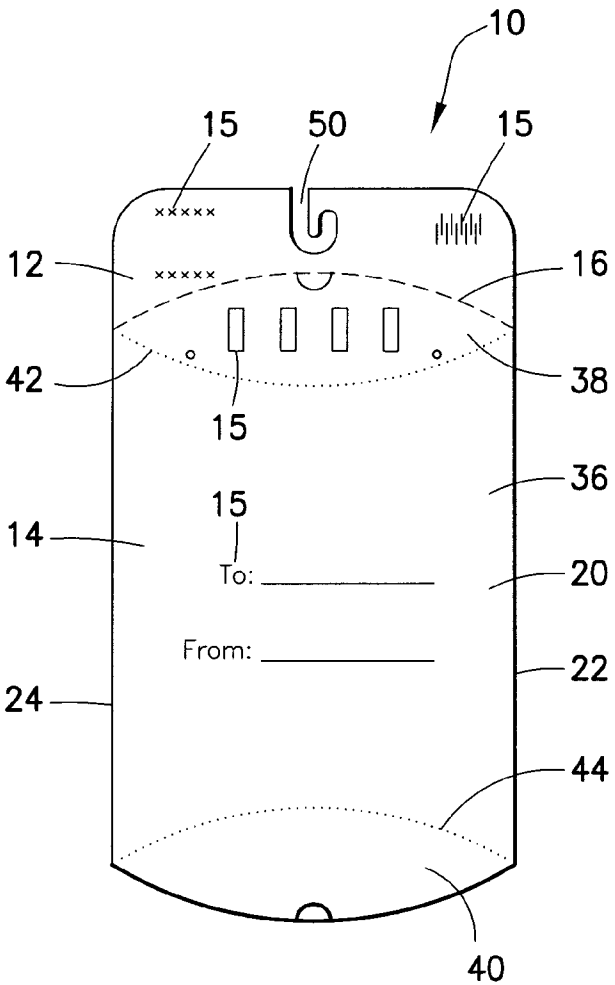
FIG. 3 is a rear view of the convertible hangtag of the invention in the display configuration.
Figure 2:
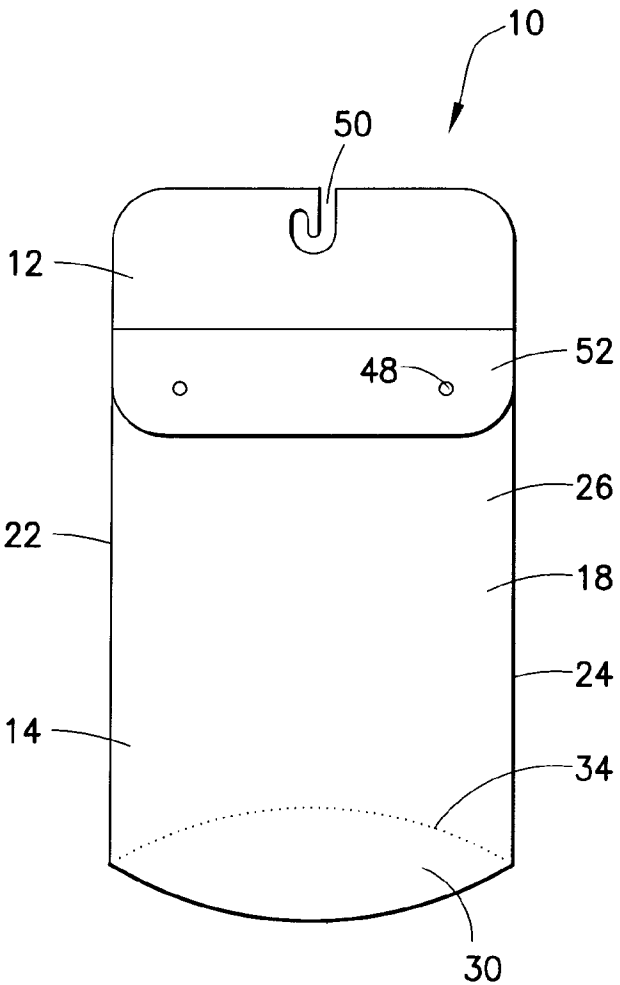
FIG. 2 is a front view of the convertible hangtag of the invention in the display configuration.
Figure 4:
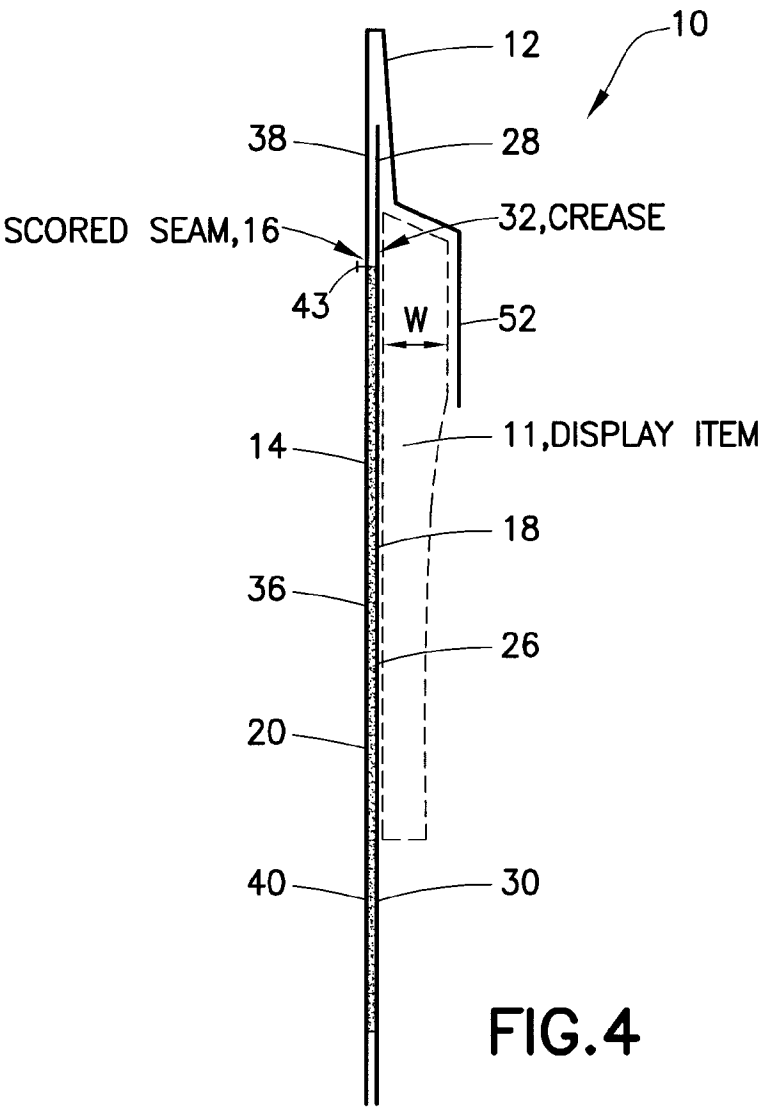
FIG. 4 is a side view of the convertible hangtag of the invention in the display configuration.

The unitary piece of material 10 is best seen with reference to FIG. 1, which shows an unfolded view of the unitary piece 10, and with reference to FIGS. 2-4, which respectively show front, rear, and side views of the unitary piece 10 folded in a display configuration. The unitary piece 10 is preferably made from cardboard, though other bendable materials known in the art, such as plastic, which are suitable for folding into a box, may be used. The unitary piece 10 includes a hanging portion 12 which, in the display configuration, hangs and displays a display item 11 (FIG. 4) secured to the unitary piece 10 for viewing by the purchasing public in retail establishments, and a boxing portion 14, which is foldable into a box configuration for packaging the display item 11 after it has been purchased. The box configuration is discussed below with respect to FIGS. 6A-8D. The hanging and boxing portions 12, 14 of the unitary piece 10 are separable along a perforation 16.

Referring to FIG. 1, the boxing portion 14 includes a front section 18 and a rear section 20 connected at a crease 22. The front section 18 includes a sheet 26, an upper flap 28 foldable about a crease 32, a lower flap 30 foldable about a crease 34, and a side flap 23 foldable about a crease 25. The rear section 20 of the boxing portion 14 includes a sheet 36, a side edge 37, an upper flap 38 foldable about a crease 42, and a lower flap 40 bendable about a crease 44. The creases 32, 42 about which the upper flaps 28, 38 are foldable and the creases 34, 44 about which the lower flaps 30, 40 are foldable are preferably shaped in a concave arc relative to the sheets 26, 36.

In the preferred embodiment, the upper and lower flaps 28, 38 of the front and rear sections 18, 20 are generally elliptical in shape but with pointed ends. Notches 54, 56 may be provided to the upper and lower flaps 38, 40 of the rear section 20 for gripping thereof to bend the flaps 38, 40 toward the front section 20 as further discussed below. Glue or other adhesive material 29 is preferably provided to the side of the sheet 36 as shown. The side flap 23 of the front section 18 may thus be folded one hundred and eighty degrees about the crease 25, and the front section 18 may be folded substantially one hundred and eighty degrees about the crease 22 to a connected configuration in which the front and rear sections 18, 20 are situated opposite each other as illustrated in FIG. 4. In this connected configuration, the side flap 23 of the front section 18 lies on top of the glue 29 (FIG. 1) along the edge 37 of the rear section 20 such that the crease 25 lines up with the edge 37 to form a seam 24 (FIGS. 2-3).

Turning back to FIG. 1, the hanging portion 12 preferably includes a first crease 46 opposite the perforation 16 for bending the hanging portion 12, and at least one hole 48 for receiving a plastic fastener 43 (FIG. 4) or other equivalent attachment means fixed to the display item 11 for securing the display item 11 to the hanging portion 12. Second and third seams 47, 49 are preferably provided to the hanging portion 12 for bending thereof. An end portion 52 of the hanging portion 12 extends outward from the third seam 49. The hanging portion 12 also defines a notch or slot 50 for receiving a hook or other clasp from which the unitary piece 10 and display item 11 secured thereto may be suspended. The slot 50 is preferably defined between the perforation 16 and the end section 52, and is preferably symmetrical about the seam 46 of the hanging portion 12. It will be appreciated that providing the slot 50 symmetrical relative to the crease 46 provides a double thickness (reinforcement) to the hanging portion 12 about the notch 50 in the display configuration further discussed below. The second and third seams 47, 49 of the hanging portion 12 are preferably parallel with the seam 46 and allow the hanging portion 12 to achieve the shape and positioning of the hanging portion 12 relative to the front section 18 of the boxing portion 14 as shown in FIG. 4, further discussed below.

Turning to FIGS. 2-3, front and rear views are shown of the convertible hangtag 10 folded in the display configuration. As shown in FIG. 2, the upper flap 28 and crease 32 of the front section 18 are covered by the end section 52 of the hanging portion 12, which hangs in front of the front section 18 as further illustrated and described below with respect to FIG. 4. As shown in FIG. 3, the rear section 20 also preferably includes various forms of indicia 15, including, but not limited to, bar codes, text, serial numbers, instructions for using the hangtag display 10, etc.

Turning to FIG. 4, a side view of the convertible hangtag 10 folded in the display configuration is shown. As shown, the upper flaps 28, 38 and lower flaps 30, 40 of the front and rear sections 18, 20 of the boxing portion 14 extend from and are coplanar with the respective sheets 26, 36 of the front and rear sections 18, 20 such that the display item 11 rests against the boxing portion 14. The display item 11 is shown schematically with dotted lines as a box in FIG. 4, and may be secured to one or both of the hanging portion 12 and boxing portion 14 by the plastic fasteners 43 which have ends slightly larger than the diameter of the holes 48 of the hanging portion 12 (FIG. 3), or any other means known in the art. It will be appreciated that this display configuration which locates the display item 11 in front of the front section 18 of the boxing portion 14 allows a potential customer to view and at least partially access the display item 11 for evaluation without removing the unitary piece 10 from a hook on which it is hung (not shown) and without removing the display item 11 from the unitary hangtag 10. It will also be appreciated that the shape of the hanging portion 12 shown in FIG. 4, achieved via the creases 46, 47, and 49 shown in FIG. 1, offsets the end portion 52 of the hanging portion 12 from the front section 18 of the boxing portion 14, thus accommodating display articles having varying widths W.

Thus, a retailer may hang the unitary piece 10 in the display configuration from a standard hook or display (not shown) by guiding the slot 50 (FIG. 2) of the hanging portion 12 over the hook and hanging the unitary piece 10 with the front section 18 facing the aisle of the store. The display item 11 hangs from the hanging portion 12 and/or front section 18 of the boxing portion 14 and rests against the front section 18. If a customer, after viewing and evaluating the display item 11 wishes to purchase it, he or she can simply remove the entire unitary piece 10 and attached display item 11 from the hook (not shown) by guiding the slot 50 off of the hook.

After purchasing the display item 11, the customer may remove the item 11 from the unitary piece 10 by cutting or pulling off the plastic T-tags 43 and/or other fasteners used to secure the display item 11 to the unitary piece 10 at the holes 48 or at other locations along the unitary piece 10. The customer may then remove the hanging portion 12 from boxing portion 14 by grasping the unitary piece 10 and tearing along the perforation 16 (FIG. 3).

Figure 5:
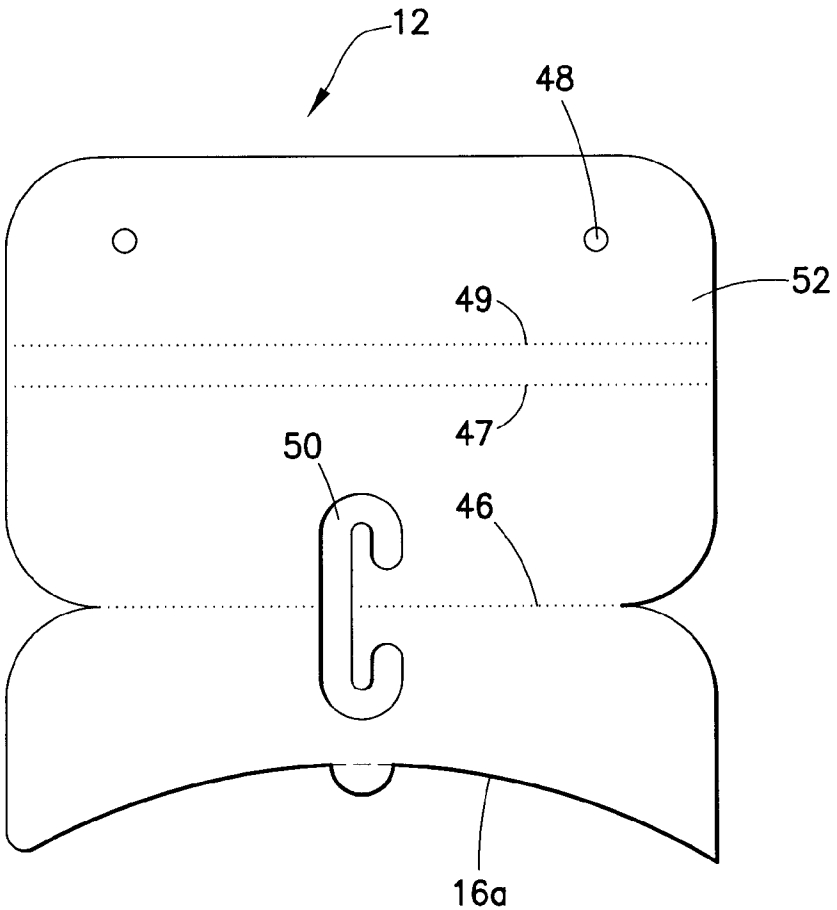
FIG. 5 is an unfolded view of the hanging portion of the hangtag of FIG. 1 removed from the boxing portion.

Turning to FIG. 5, an unfolded view of the hanging portion 12 is shown. In FIG. 5, the hanging portion 12 has been detached from the boxing portion 14, and now has a bottom edge 16*a*. Prior to separation from the boxing portion 14, the bottom edge 16*a* of the hanging portion 12 ran along the perforation 16.

Figure 6B:
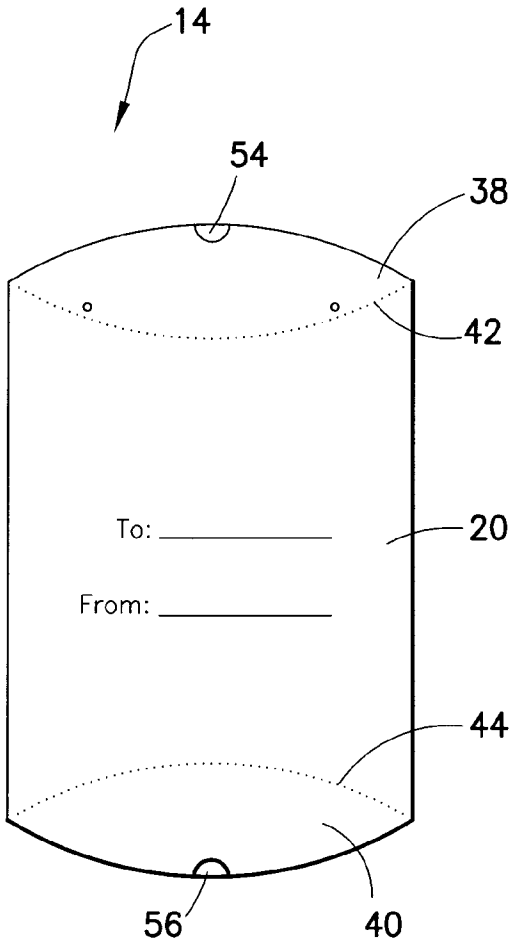
FIG. 6B is a rear view of the boxing portion of the invention after removal of the hanging portion.
Figure 6A:
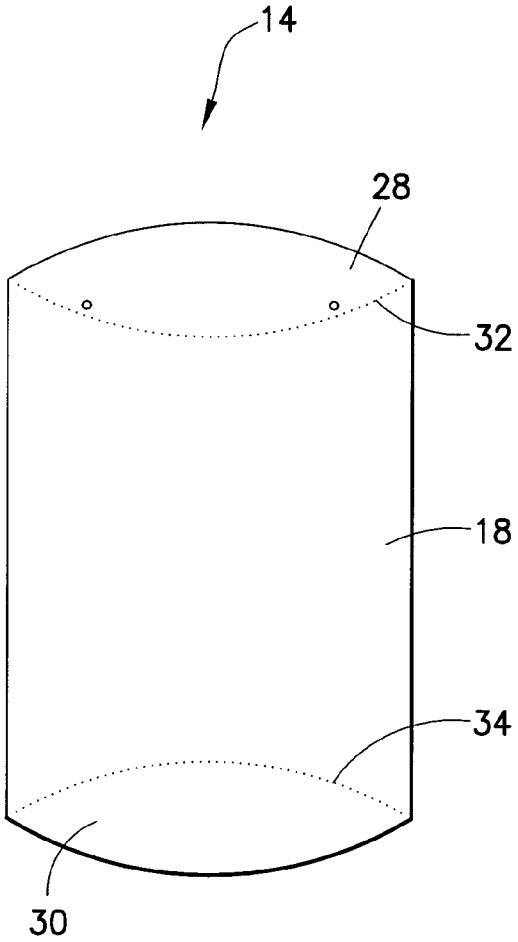
FIG. 6A is a front view of the boxing portion of the invention after removal of the hanging portion.

Turning to FIGS. 6A-6B, front and rear views of the boxing portion 14 of the unitary hangtag 10 are shown after the hanging portion 12 has been detached from the boxing portion 14. As discussed above, the upper and lower flaps 28, 30 of the front section 18 are bendable about corresponding upper and lower creases 32, 34, and the upper and lower flaps 38, 40 of the rear section 20 are bendable about corresponding upper and lower creases 42, 44. The upper and lower flaps 28, 30 of the front section 18 are then pushed over the upper and lower flaps 38, 40 of the rear section 20 to form the box shown in FIGS. 7A-7B, 8D.

Figure 7B:
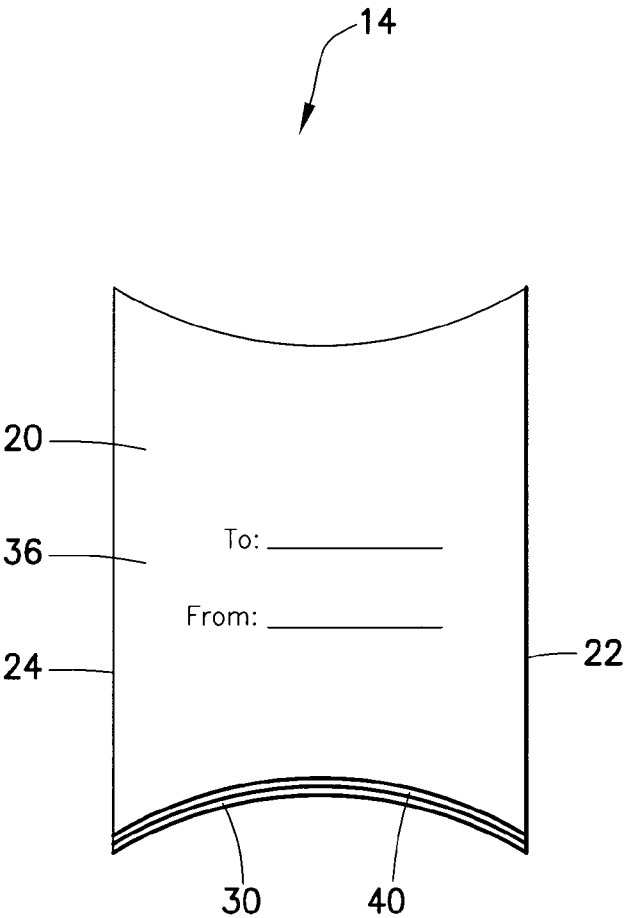
FIG. 7B is a rear view of the boxing portion in the box configuration.
Figure 7A:
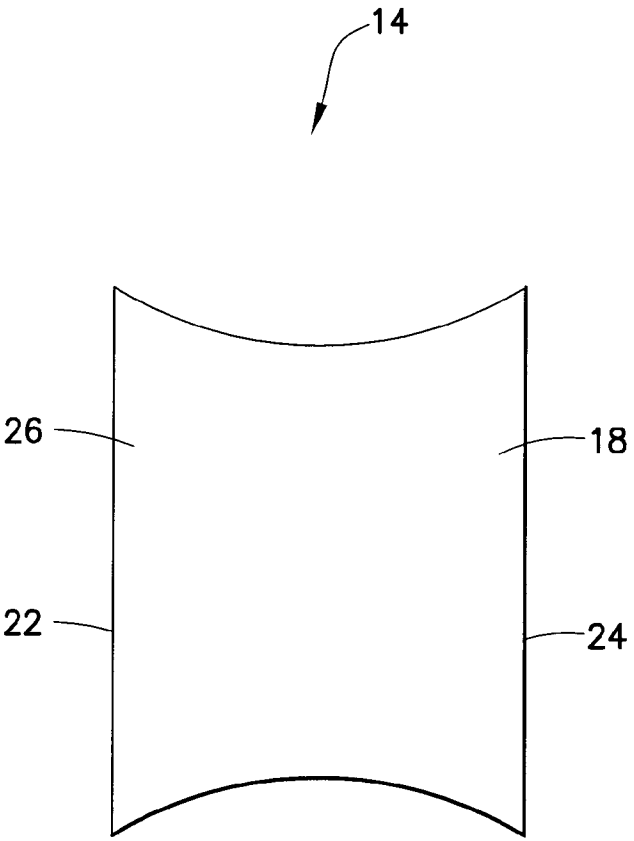
FIG. 7A is a front view of the boxing portion in the box configuration.

Turning to FIGS. 7A-7B front and rear views of the boxing portion 14 are shown in which the hanging portion 12 has been detached from the unitary piece 10 and the upper flaps 28, 38 and lower flaps 30, 40 of the front and rear sections 18, 20 have all been folded in a transverse direction relative to the respective sheets 26, 36 to form a box for packaging or storing the display item 11. As shown, the lower flaps 30, 40 extending from the oppositely facing front and rear sections 18, 20 fold adjacent to each other (FIG. 7B) (i.e. one atop the other)

to form a reinforced end wall of the box, and the upper flaps 28, 38 (both of which are hidden) extending from the front and rear sections 18, 20 fold adjacent to each other to form the opposite reinforced endwall of the box. The front and rear sections 18, 20, which now form the main sidewalls of the box, are preferably bowed outward opposite each other and relative to the crease 22 and seam 24 which connect them. It will be appreciated that the preferably generally elliptical shape of the flaps, the concave shape of the creases about which the flaps fold, and the outward bowing of the sheets opposite each other will provide an aesthetic shape suitable for a gift box and an interior portion which can accommodate display items of different sizes. If desired, gift-giving indicia such as "To: _____" and "From: _____" can be provided one of the walls 18, 20.

Figure 8A:
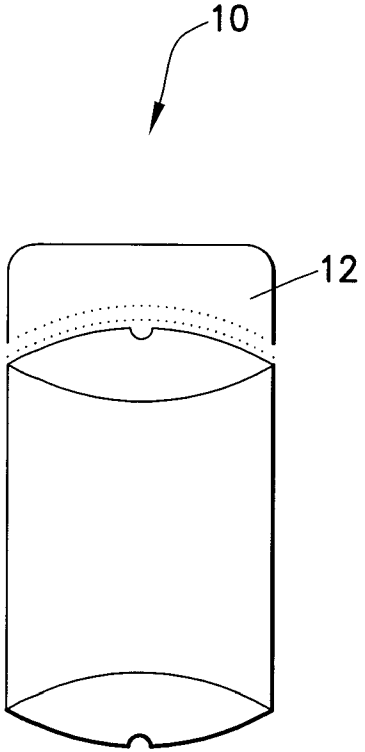
FIG. 8A is a perspective, partially exploded view of the hangtag of the invention.
Figure 8B:
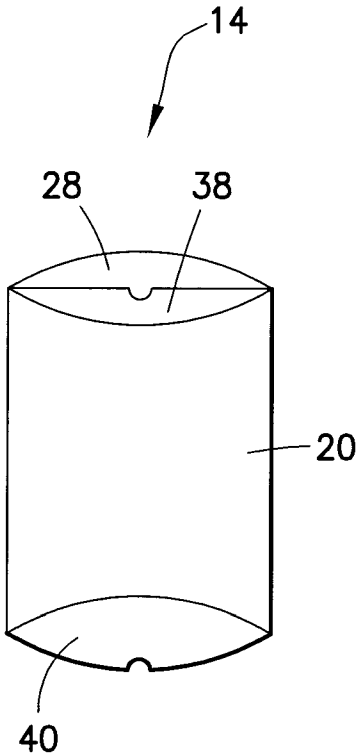
FIG. 8B is a perspective view of the boxing portion of the invention prior to folding the upper and lower flaps.
Figure 8C:
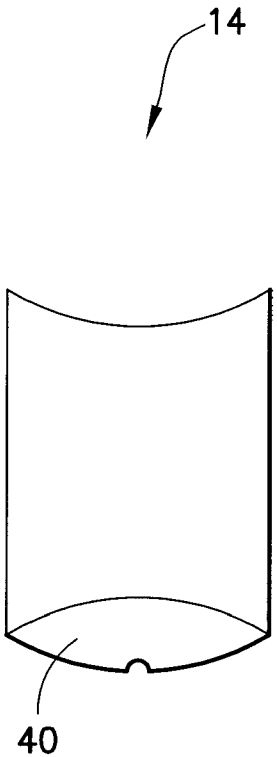
FIG. 8C is a perspective view of the boxing portion of the invention after the upper flaps have been folded.
Figure 8D:
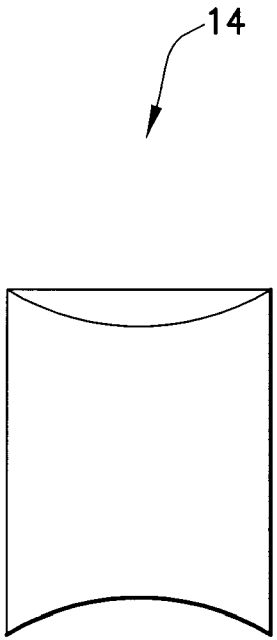
FIG. 8D is a perspective view of the boxing portion of the invention after the upper and lower flaps have been folded.

FIGS. 8A-8D show views of the hangtag display 10 in progressive stages. FIG. 8A shows a rear view of the hanging portion 12 of the hangtag display 10 removed from the boxing portion 14. FIG. 8B shows a perspective view of the boxing portion 14 with the upper flap 38 of the rear section 20 folded and the upper flap 28 of the front section 18 unfolded, and with the lower flaps 30 (hidden), 40 unfolded. FIG. 8C shows the boxing portion 14 with the both of the upper flaps folded and the lower flaps 30 (hidden), 40 unfolded. FIG. 8D shows the boxing portion 14 in the box configuration with the upper and lower flaps all folded.

There has been described and illustrated herein a preferred embodiment of a unitary piece of material foldable into a hanging portion for hanging and displaying a retail item and a boxing portion for packaging the retail item. While a preferred embodiment of the invention have been described, it is not intended that the invention be limited thereto, as it is intended that the invention be as broad in scope as the art will allow and that the specification be read likewise. Thus, while particular shapes have been disclosed with respect to the upper and lower flaps of the front and rear sections, the creases about which the flaps are foldable, and the hanging portion, it will be appreciated that other shapes may be used as well. In addition, while a particularly shaped slot has been disclosed for receiving a display hook or other hanging device, it will be understood that other shaped slots can be used. Also, while the unitary piece is disclosed as being made from cardboard, it will be recognized that other materials or composites such as plastic may be used which allow the boxing portion to maintain its shape once the upper and lower flaps are closed into the box configuration. Furthermore, while the unitary piece has been disclosed as supporting a retail display item, it will be appreciated that the display item may consist of one or more of a variety of goods, including various types of gift items and accessories commonly sold in retail stores etc. Moreover, while a particular display configuration has been disclosed, it will be appreciated that other configurations could be used as well, such as, for example, one in which the hanging portion extends from the front section of the boxing portion. Additionally, while a particular seam has been disclosed for connecting oppositely facing sheets, it will be appreciated that other connections could be used as well. It will therefore be appreciated by those skilled in the art that yet other modifications could be made to the provided invention without deviating from its spirit and scope as claimed.

What is claimed is:

1. A convertible hangtag display for use with an item secured to the display, comprising:

a unitary piece of material having a hanging portion and a boxing portion, said hanging portion configured for hanging and displaying the item, said boxing portion configured for packaging the item, said hanging portion separable from said boxing portion along a perforation, said boxing portion having oppositely facing front and rear sheets connected to each other by either a crease or a seam, upper and lower flaps extending from opposite ends of each of the respective sheets, upper creases shaped as generally concave arcs and corresponding to each of said upper flaps, and lower creases shaped as generally concave arcs and corresponding to each of said lower flaps, said upper and lower flaps foldable about said corresponding upper and lower creases, said perforation being located at a top edge of said upper flap extending from said rear sheet, said hanging portion having at least one crease opposite said perforation, said hanging portion defining a slot for receiving a hook, wherein, in a box configuration, said upper and lower flaps extend in a transverse direction relative to the front and rear sheets whereby said sheets and said upper and lower flaps extending therefrom form a box configured to contain the item with said oppositely facing front and rear sheets bowed outward opposite each other, and in a display configuration, each of said upper and lower flaps extends in a direction coplanar with the respective sheet from which it extends, and wherein in said display configuration, said hanging portion includes an end section suspended in front of said front sheet such that the item is situated between said front sheet and said end section.

2. A convertible hangtag display for use with an item secured to the display, comprising:

a unitary piece of material having a hanging portion and a boxing portion, said hanging portion configured for hanging and displaying the item, said boxing portion configured for packaging the item, said hanging portion separable from said boxing portion along a perforation, said boxing portion having oppositely facing front and rear sheets connected to each other, upper and lower flaps extending from opposite ends of each of the respective sheets, upper creases corresponding to each of said upper flaps, and lower creases corresponding to each of said lower flaps, said upper and lower flaps foldable about said corresponding upper and lower creases, said perforation located at a top edge of the upper flap extending from said rear sheet, and said hanging portion having at least one crease opposite said perforation, said hanging portion defining a slot for receiving a hook, wherein, in a box configuration, said upper and lower flaps extend in a transverse direction relative to sheets of said boxing portion whereby said sheets and said upper and lower flaps extending therefrom form a box configured to contain the item.

3. A convertible hangtag display according to claim 2, wherein:

in a display configuration, each of said upper and lower of said boxing portion extends in a direction coplanar with the respective sheet from which it extends.

4. A convertible hangtag display according to claim 2, wherein:

said front and rear sheets are connected by a crease.

5. A convertible hangtag display according to claim 2, wherein:

said front and rear sheets are connected by a seam.

6. A convertible hangtag display according to claim 2, wherein:

said creases corresponding to said upper flaps are shaped in a concave arc.

7. A convertible hangtag display according to claim 6, wherein:

said creases corresponding to said lower flaps are shaped in a concave arc.

8. A convertible hangtag display according to claim 2, wherein:

said upper flaps are generally elliptical in shape.

9. A convertible hangtag display according to claim 5, wherein:

said lower flaps are generally elliptical in shape.

10. A convertible hangtag display according to claim 2, wherein:

said hanging portion defines at least one hole for receiving a plastic fastener attached to the item for securing the item to the hanging portion.

11. A convertible hangtag display according to claim 10, wherein:

said boxing portion defines at least one hole for receiving the plastic fastener for securing the item to said boxing portion.

12. A convertible hangtag display according to claim 2, wherein:

in said display configuration, said hanging portion includes an end section suspended in front of said front sheet such that the item is situated between said front sheet and said end section of said hanging portion.

13. A convertible hangtag display according to claim 2, wherein:

said at least one crease of said hanging portion includes a first crease and a second crease parallel with said first crease.

14. A convertible hangtag display according to claim 13, wherein:

said slot of said hanging portion is symmetrical about said first crease.

15. A convertible hangtag display according to claim 2, wherein:

said unitary piece of material is cardboard.

16. A convertible hangtag display according to claim 2, wherein:

said unitary piece of material is plastic.

17. A convertible hangtag display according to claim 2, wherein:

said upper flap extending from said rear sheet defines a notch for gripping said upper flap extending from said rear sheet.

18. A convertible hangtag display according to claim 17, wherein:

said lower flap extending from said rear sheet defines a notch for gripping said lower flap extending from said rear sheet.

19. A convertible hangtag display according to claim 2, wherein:

in said box configuration said oppositely facing front and rear sheets are bowed outward opposite each other.

* * * * *